US005691894A

United States Patent [19]

Fukushima et al.

[11] Patent Number: 5,691,894

[45] Date of Patent: Nov. 25, 1997

[54] CYLINDER POSITIONING CONTROL APPARATUS

[75] Inventors: Kenji Fukushima; Hitoshi Yamamoto; Nobuhiro Fujiwara; Hiroyuki Shimono, all of Yawara-mura, Japan

[73] Assignee: SMC Corporation, Tokyo, Japan

[21] Appl. No.: 564,715

[22] Filed: Nov. 29, 1995

[30] Foreign Application Priority Data

Feb. 6, 1995 [JP] Japan ..... 7-039406

[51] Int. Cl.[6] ..... F01B 15/00; F01B 25/04; F15B 13/16

[52] U.S. Cl. ..... 364/148; 91/361; 91/196; 91/170 R; 91/171

[58] Field of Search ..... 364/148, 565, 364/561, 174; 91/1, 170 R, 171, 176, 181, 216 R, 197, 358 R, 361; 303/10, 113.1, 113.2, 113.3, 113.4

[56] References Cited

U.S. PATENT DOCUMENTS

| | | | |
|---|---|---|---|
| 4,779,513 | 10/1988 | Kimura | 92/5 L |
| 4,804,913 | 10/1988 | Shimizu | 324/207.23 |
| 4,826,255 | 5/1989 | Volz | 303/10 |
| 4,932,311 | 6/1990 | Mibu et al. | 91/361 |
| 5,275,085 | 1/1994 | Hur | 91/170 R |

FOREIGN PATENT DOCUMENTS 7127602A 5/1995 Japan .

*Primary Examiner*—Emanuel T. Voeltz
*Assistant Examiner*—Demetra R. Smith
*Attorney, Agent, or Firm*—Brumbaugh, Graves, Donohue & Raymond

[57] ABSTRACT

A cylinder positioning control apparatus designed to effect positioning of a cylinder by learning control that uses not only an overrun distance but also a cylinder speed as input data for control. The apparatus has a device for taking in a displacement x and speed V of a cylinder, a device for calculating a predicted overrun distance $y_i$ for the present drive from a predicted overrun distance $y_{i-1}$ in the preceding drive, a cylinder speed $V_{i-1}$ at the time of outputting a braking signal during the preceding drive, and a speed $V_i$ of the cylinder being driven, a device for judging whether or not a condition to be satisfied to output a braking signal is satisfied, and for outputting a braking signal when the condition is satisfied, a device for taking in a displacement $x_{bp}$ and speed $V_{bp}$ of the cylinder when the braking signal is output, a device for taking in a displacement $x_{stop}$ of the cylinder when it has stopped, and a device for calculating a predicted overrun distance $y_{1-1}$ and a cylinder speed $V_{i-1}$ at the time of outputting a braking signal, which are to be used in calculation for the subsequent drive, from the displacement $x_{bp}$ and speed $V_{bp}$ of the cylinder when the braking signal was output, and the displacement $x_{stop}$ of the cylinder stopped.

4 Claims, 2 Drawing Sheets

CYLINDER POSITIONING CONTROL APPARATUS

BACKGROUND OF THE INVENTION

The present invention relates to a cylinder positioning control apparatus which is designed to stop a repeatedly operating cylinder at a designated position.

The present applicant has previously filed an application concerning a cylinder stop control apparatus having a braking mechanism for braking a piston rod, and a position sensor for detecting a position of the piston rod, wherein the movement of the piston rod is controlled by a drive valve which allows compressed air to flow out according to an electric signal outputted from a controller, thereby stopping the cylinder at a designated position [see Japanese Patent Application No. 5-297553 (Japanese Patent Application Unexamined Publication (KOKAI) No. 7-127692)]. In this unknown cylinder stop control apparatus, an overrun distance in the preceding drive is used as a predicted overrun distance in the subsequent drive, and the braking point is corrected by an amount corresponding to the overrun distance, thereby effecting positioning. However, this control method has the disadvantage that no sufficiently high accuracy can be obtained when a speed variation occurs.

SUMMARY OF THE INVENTION

It is obvious that learning control that takes the cylinder speed into consideration is needed in order to obtain sufficiently high positioning accuracy regardless of speed variation.

An object of the present invention is to effect positioning of a cylinder by learning control that uses not only an overrun distance but also a cylinder speed as input data for control.

To attain the above-described object, the present invention provides a cylinder positioning control apparatus having the following devices (a) to (f):

(a) a device for taking in a displacement x and speed V of a cylinder;

(b) a device for calculating a predicted overrun distance $y_i$ for the present drive from a predicted overrun distance $y_{i-1}$ in the preceding drive, a cylinder speed $V_{1-1}$ at the time of outputting a braking signal during the preceding drive, and a speed $V_i$ of the cylinder being driven;

(c) a device for judging whether or not a condition to be satisfied to output a braking signal is satisfied, and for outputting a braking signal when the condition is satisfied;

(d) a device for taking in a displacement $x_{bp}$ and speed $V_{bp}$ of the cylinder when the braking signal is output;

(e) a device for taking in a displacement $x_{stop}$ of the cylinder when it has stopped; and (f) a device for calculating a predicted overrun distance $y_{i-1}$ and a cylinder speed $V_{i-1}$ at the time of outputting a braking signal, which are to be used in calculation for the subsequent drive, from the displacement $x_{bp}$ and speed $V_{bp}$ of the cylinder when the braking signal was output, and the displacement $x_{stop}$ of the cylinder stopped.

The cylinder positioning control apparatus of the present invention may further have a device for judging whether or not the cylinder has been suspended for a long time immediately after a control operation has started, and for causing a braking mechanism to perform an on-off operation several times when it is judged that the cylinder has been suspended for a long time.

In the present invention, a predicted overrun distance $y_i$ for the present drive is calculated from the predicted overrun distance $y_{i-1}$ in the preceding drive, the cylinder speed $V_{i-1}$ at the time of outputting a braking signal during the preceding drive, and the speed $V_i$ of the cylinder being driven, and the brake is operated by taking into consideration the predicted overrun distance $y_i$ for the present drive. Further, a predicted overrun distance $y_{i-1}$ and a cylinder speed $V_{i-1}$ at the time of outputting a braking signal, which are to be used in calculation for the subsequent drive, are calculated from the displacement $x_{bp}$ and speed $V_{bp}$ of the cylinder when a braking signal is output, and the displacement $x_{stop}$ of the cylinder stopped. By repeating learning in this way, a predicted overrun distance $y_i$ of improved accuracy can be obtained.

In the present invention, a predicted overrun distance $y_i$ for the present drive is calculated by using the predicted overrun distance $y_{i-1}$ in the preceding drive, the cylinder speed $V_{i-1}$ when a braking signal was output during the preceding drive, and the speed $V_i$ of the cylinder being driven. Accordingly, positioning of the cylinder is effected by learning control in which not only an overrun distance but also a cylinder speed is taken in as input data for control. Thus, the cylinder stop accuracy is improved to a considerable extent.

DESCRIPTION OF THE EMBODIMENT

Figure 1:
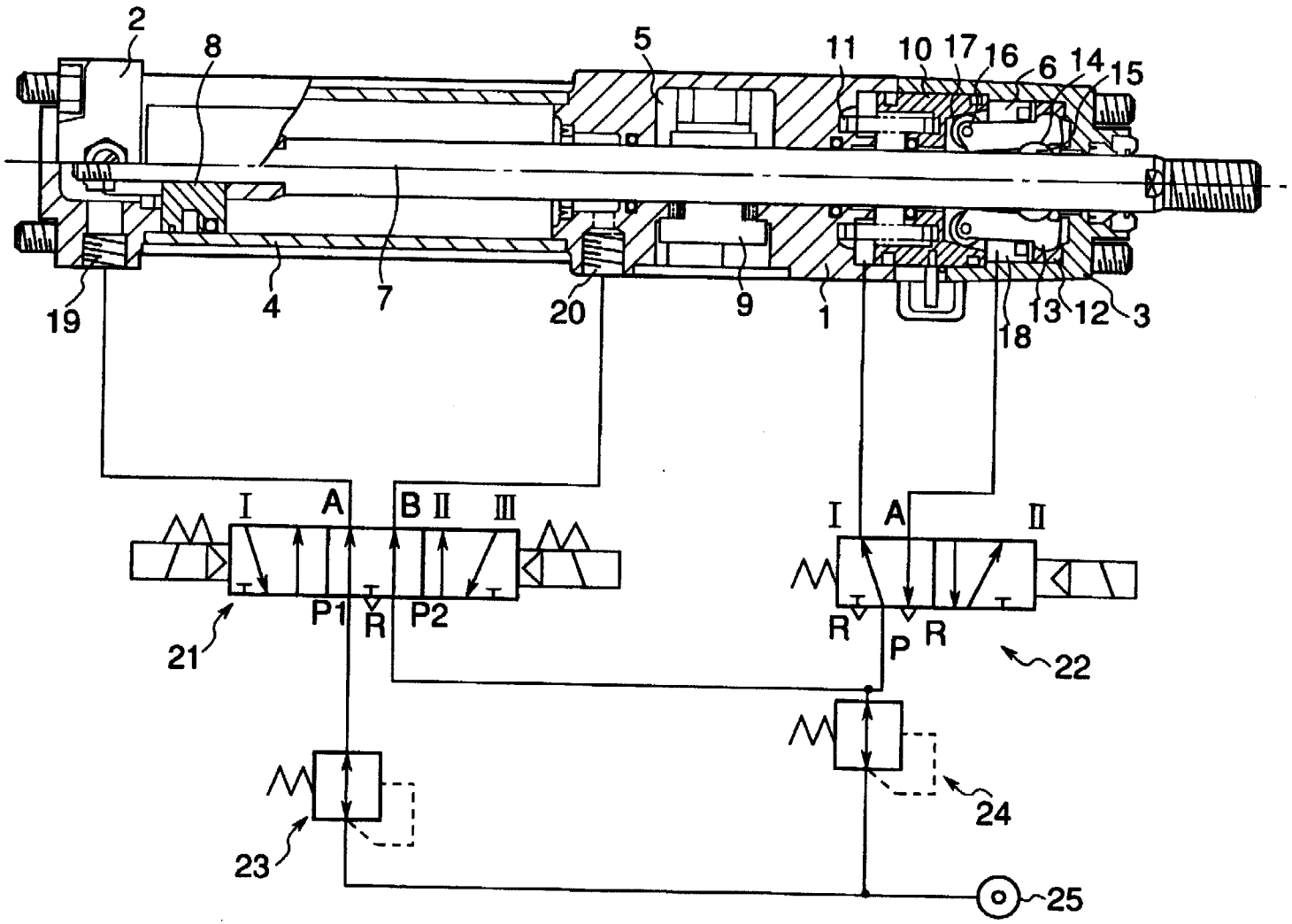
FIG. 1 shows an embodiment in which the present invention is applied to an air cylinder.

FIG. 1 shows an embodiment in which the present invention is applied to an air cylinder. In FIG. 1, a head cover 2 is connected to the left end of a cylinder tube 4, and a rod cover 1 is connected to the right end of the cylinder tube 4. A cover 3 is connected to the right end of the rod cover 1. A rod cover chamber 5 is formed in the rod cover 1, and a cover chamber 6 is defined between the rod cover 1 and the cover 3. A piston rod 7 is slidably received in a central bore axially extending through the rod cover 1 and the cover 3. A piston 8 is fixed to the left end portion of the piston rod 7. The piston 8 is slidably fitted in the cylinder tube 4. A position sensor 9 is disposed in the rod cover chamber 5 at a position which faces a magnetic scale provided on the piston rod 7. A signal detected by the position sensor 9 is transmitted to a controller through a cable (not shown).

A braking mechanism is disposed in the cover chamber 6. A brake piston 10 is slidably fitted in a large-diameter portion of the cover chamber 6. The brake piston 10 is biased rightward by resilient force from a brake spring 11. An arm holder 12 is fixed to the right end of the cover chamber 6. The arm holder 12 pivotably supports the right end portions of a plurality of brake arms 13. A recess is formed on the inner side of the right end portion of each brake arm 13, and a brake shoe holder 14 is fitted in the recess. A brake shoe 15 is fixed to the inner side of the brake shoe holder 14. The inner side of the brake shoe 15 faces the surface of the piston rod 7. Each brake arm 13 has a pin 16 which is attached to the left end portion thereof, and a roller 17 is rotatably attached to the pin 16. The inner surface of the right end portion of the brake piston 10 is formed with a frusto-conical cam surface (having the largest inside diameter at the right end thereof). The rollers 17 of the brake arms 13 are engaged with the cam surface. When the brake piston 10 is caused to move rightward by the resilient force from the brake spring 11, the brake arms 13 pivot inward, and the brake shoe 15 is pressed against the surface of the piston rod 7, thus producing braking force. When air is supplied to a brake chamber 18 which is provided on the right side of the brake piston 10, the brake piston 10 moves leftward, canceling the braking force.

The head cover 2 is provided with a head-side port 19 which is communicated with a head-side chamber in the cylinder tube 4. The rod cover 1 is provided with a rod-side port 20 which is communicated with a rod-side chamber in the cylinder tube 4. The head-side port 19 is communicated with an A-port of a solenoid-controlled valve 21 for driving through piping. Similarly, the rod-side port 20 is communicated with a B-port of the driving solenoid-controlled valve 21. A P1-port of the driving solenoid-controlled valve 21 is communicated with an outlet-side port of a pressure regulating valve 23, and a P2-port of the driving solenoid-controlled valve 21 is communicated with an outlet-side port of a pressure regulating valve 24. The brake chamber 18 in the cover 3 is communicated with an A-port of a solenoid-controlled valve 22 for braking through piping. A P-port of the braking solenoid-controlled valve 22 is communicated with an outlet-side port of the pressure regulating valve 24.

In the position shown in FIG. 1, the air in the brake chamber 18 is released to the atmosphere through the A- and R-ports of the braking solenoid-controlled valve 22, and thus the brake is put on by the air pressure in the other chamber and the resilient force of the brake spring 11. The head-side chamber in the air cylinder is supplied with compressed air from an air-pressure source 25 through the pressure regulating valve 23 and the P1- and A- ports of the driving solenoid-controlled valve 21. The rod-side chamber of the air cylinder is supplied with compressed air from the air-pressure source 25 through the pressure regulating valve 24 and the P2- and B-ports of the driving solenoid-controlled valve 21. At this time, the piston 8 is suspended, and forces acting on the two sides of the piston 8 are approximately equal to each other.

When the braking solenoid-controlled valve 22 is switched to a position II, compressed air from the air-pressure source 25 flows into the brake chamber 18 through the pressure regulating valve 24 and the P- and A-ports of the braking solenoid-controlled valve 22, causing the brake to be taken off. When the driving solenoid-controlled valve 21 is switched to a position III, compressed air from the pressure regulating valve 23 flows into the head-side chamber, causing the piston 8 to move rightward. When the driving solenoid-controlled valve 21 is switched to a position I, compressed air from the pressure regulating valve 24 flows into the rod-side chamber, causing the piston 8 to move leftward.

Figure 2:
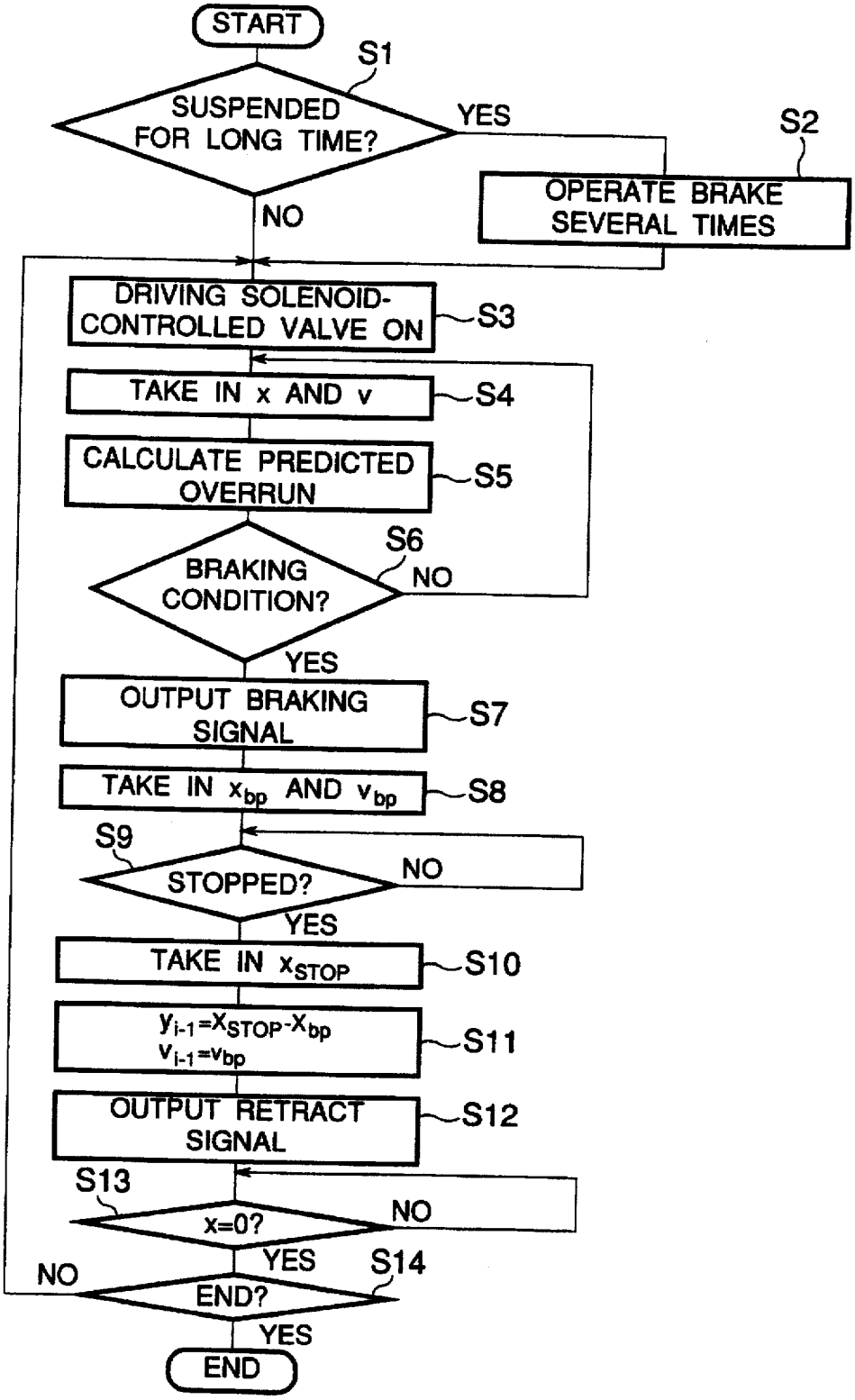
FIG. 2 is a flowchart showing a control method of the present invention.

FIG. 2 is a flowchart showing a control method of the cylinder positioning control apparatus according to the present invention. First of all, some operations executed at Steps in the flowchart will be explained.

First, estimation of an overrun distance will be explained. The overrun distance y of the cylinder (to be precise, the piston of the cylinder) may be divided into two on the basis of the time when a braking signal is output: an overrun distance $y_1$ during braking dead time between the moment a braking signal is output and the moment a braking operation is initiated (i.e. the brake begins to work); and an overrun distance $y_2$ after the braking operation has been initiated.

Assuming that the cylinder speed when a braking signal is output is V, and the braking dead time is $t_{lag}$, the overrun distance $y_1$ during the dead time is given by $$y_1=t_{lag}V \tag{1}$$

Assuming that braking force is F, and load is M, and that the brake absorbs all the kinetic energy of the cylinder, the overrun distance $y_2$ after the braking operation has been initiated is given by the following equation according to the energy conservation law:

$$Fy_2=MV^2/2 \text{ i.e. } y_2=MV^2/2F \tag{2}$$

Accordingly, the overall overrun distance y can be estimated from Eqs.(1) and (2) as follows:

$$y=y_1+y_2=t_{lag}V+MV^2/2F \tag{3}$$

Next, the determination of a predicted overrun distance which takes the cylinder speed into consideration will be explained.

Since the cylinder is repeatedly driven (run), it is assumed that an overrun distance is determined by taking into consideration a predicted overrun distance $y_{i-1}$ in the preceding drive, a cylinder speed $V_{i-1}$ when a braking signal was output during the preceding drive, and a speed variation with respect to the cylinder speed. If we use the Taylor expansion including the terms up to the second order, the predicted overrun distance $y_i$ is given by $$y_i = y_{i-1} + \frac{dy_{i-1}}{dV_{i-1}}(v_i - v_{i-1}) + \frac{d^2y_{i-1}}{2dV_{i-1}^2}(V_i - V_{i-1})^2 \tag{4}$$

If the overrun distance y of Eq.(3) is used, Eq.(4) becomes as follows:

$$y_i = y_{i-1} + \left(t_{lag} + \frac{M}{F}V_{i-1}\right)(V_i - V_{i-1}) + \frac{M}{2F}(V_i - V_{i-1})^2 \tag{5}$$

Since the overrun distance $y_{i-1}$ in the preceding drive satisfies Eq.(3), the following equation is obtained:

$$y_{i-1} = t_{lag}V_{i-1} + \frac{M}{2F}V_{i-1}^2 \tag{6}$$

$$\frac{M}{F} = \frac{2(y_{i-1} - t_{lag}V_{i-1})}{V_{i-1}^2}$$

If Eq.(6) is substituted into Eq.(5), the following equation is obtained:

$$y_i = y_{i-1} + \left\{\frac{2y_{i-1}}{V_{i-1}} - t_{lag}\right\}(V_i - V_{i-1}) + \frac{(y_{i-1} - V_{i-1}t_{lag})(V_i - V_{i-1})^2}{V_{i-1}^2} \tag{7}$$

The predicted overrun distance $y_i$ can be obtained from Eq. (7).

Next, the determination of a braking point will be explained.

If the stop target displacement (position) is assumed to be $x_r$, and the predicted overrun distance $y_i$ of Eq.(7) is used, the braking point [the displacement (position) at which a braking signal is to be output] $b_p$ is given by $$b_p=x_r-y_i \tag{8}$$

As will be understood from Eq.(8), a braking signal should be output when the cylinder displacement x becomes equal to the braking point $b_p$. However, since the counter value is taken in at a predetermined sampling time, if the sampling time is assumed to be $t_s$, an error of $t_sV_i$ is produced with respect to the displacement $b_p$ which can be actually taken in.

In order to make the error vary about the displacement $b_p$, a braking signal is output when the following Eq.(9) is satisfied:

$$\frac{3x_t - x_{t-1}}{2} > x_t - y_i \quad (9)$$

In the above Eq.(9), $x_t$ is the displacement taken in at the present time, and $x_{t-1}$ is the displacement taken in immediately before the present time. Assuming that the cylinder is performing a uniform motion, it is possible to predict that the displacement $x_{t+1}$ immediately after the present time will be as follows:

$$x_{t+1}=x_t+(x_t-x_{t-1}) \quad (10)$$

Since the displacement $x_t$ needs to be closer to the displacement $b_p$ than the displacement $x_{t+1}$, it is necessary to satisfy the following equation:

$$x_{t+1}-b_p>b_p-x_t \quad (11)$$

Thus, Eq.(9) is obtained by rearranging Eqs.(10) and (11).

Next, the control of the cylinder positioning control apparatus will be explained with reference to the flowchart of FIG. 2.

When the control program starts, it is judged at Step S1 whether or not the air cylinder has been suspended for a long time. If the air cylinder is left at rest for a long time because the factory closes for a vacation, for example, the braking characteristics of the braking mechanism change, causing the air cylinder stop accuracy to be deteriorated. Although it is difficult to predict the change of the braking characteristics due to the suspension of the air cylinder for a long time, it has been revealed that the braking characteristics are restored to those before the suspension by repeating the on-off operation of the braking mechanism several times (5 or 6 times). Therefore, in order to improve the stop accuracy deteriorated owing to the suspension of the air cylinder for a long time, whether or not the air cylinder has been suspended for a long time is judged at Step S1.

If the air cylinder has not been suspended for a long time, the process proceeds to Step S3, whereas, if it has been suspended for a long time, the on-off operation of the braking mechanism is repeated several times at Step S2, and thereafter, the process proceeds to Step S3.

At Step S3, the driving solenoid-controlled valve 21 is turned on. For example, the driving solenoid-controlled valve 21 is switched to the position III, and thus the piston 8 begins to move rightward.

At Step S4, the position x and speed V of the piston 8 of the air cylinder are calculated from the input signal from the position sensor 9, and inputted to the computer.

At Step S5, a predicted overrun distance $y_i$ is calculated from the predicted overrun distance $y_{i-1}$ in the preceding drive, the cylinder speed $V_{i-1}$ when a braking signal was output during the preceding drive, the speed $V_i$ of the cylinder being driven, and the braking dead time $t_{lag}$ by use of the above Eq.(7).

At Step S6, it is judged whether or not the above Eq.(9) concerning the condition to be satisfied to output a braking signal is satisfied by using the displacement $x_t$ of the cylinder being driven, the cylinder displacement $x_{t-1}$ inputted immediately before the present time, the cylinder stop target displacement $x_t$, and the predicted overrun distance $y_i$ calculated at Step S5. If the condition of Eq.(9) is not satisfied, the process returns to Step S4, whereas, if it is satisfied, the process proceeds to Step S7.

At Step S7, a braking signal is output. At this time, the braking solenoid-controlled valve 22 is switched to the position II. Consequently, compressed air flows into the brake chamber 18 through the P- and A-ports of the braking solenoid-controlled valve 22, thus initiating a braking operation. At the same time, the driving solenoid-controlled valve 21 is returned to the position II.

At Step S8, the displacement $x_{bp}$ and speed $V_{bp}$ of the cylinder at the time of outputting the braking signal are taken in.

At Step S9, it is judged whether or not the cylinder has stopped by the braking operation of the braking mechanism. If the cylinder has stopped, the process proceeds to Step S10.

At Step S10, the displacement $x_{stop}$ of the cylinder stopped is taken in.

At Step S11, the equation of $y_{i-1}=x_{stop}-x_{bp}$ and the equation of $V_{i-1}=V_{bp}$ are calculated by using the data taken in at Steps S8 and S10.

Results of the calculation executed at Step S11 are used as the overrun distance $y_{i-1}$ in the preceding drive and the cylinder speed $V_{i-1}$ at the time of outputting a braking signal during the preceding drive in calculation of a predicted overrun distance in the subsequent drive. By repeating learning in this way, a predicted overrun distance is determined taking into consideration a speed variation as well.

At Step S12, a retract signal is output. At this time, the driving solenoid-controlled valve 21 is switched to the position I, and the braking solenoid-controlled valve 22 is also switched to the position I. Consequently, compressed air flows into the rod-side chamber from the pressure regulating valve 24 through the P2- and B-ports of the driving solenoid-controlled valve 21 and the rod-side port 20, and compressed air also flows into the brake chamber 18 from the pressure regulating valve 24 through the P- and A-ports of the braking solenoid-controlled valve 22. Thus, the braking operation of the braking mechanism is canceled, and the piston 8 moves leftward.

At Step S13, it is judged whether or not the cylinder has returned to the start point where the displacement x=0. If YES, the process proceeds to Step S14.

At Step S14, it is judged whether or not the control process should be terminated. If YES, the process is terminated, whereas, if NO, the process returns to Step S3.

What is claimed is:

1. A cylinder positioning control apparatus comprising:

(a) means for taking in a displacement x and speed V of a cylinder;

(b) means for calculating a predicted overrun distance $y_i$ for a present drive from a predicted overrun distance $y_{i-1}$ in a preceding drive, a cylinder speed $V_{i-1}$ at the time of outputting a braking signal during the preceding drive, and a speed $V_i$ of the cylinder being driven;

(c) means for judging whether or not a condition to be satisfied to output a braking signal is satisfied, and for outputting a braking signal when said condition is satisfied;

(d) means for taking in a displacement $x_{bp}$ and speed $V_{bp}$ of the cylinder when the braking signal is output;

(e) means for taking in a displacement $x_{stop}$ of the cylinder when it has stopped; and (f) means for calculating a predicted overrun distance $y_{i-1}$ and a cylinder speed $V_{i-1}$ at the time of outputting a braking signal, which are to be used in calculation for a subsequent drive, from the displacement $x_{bp}$ and speed $V_{bp}$ of the cylinder when the braking signal was output, and the displacement $x_{stop}$ of the cylinder stopped.

2. A cylinder positioning control apparatus according to claim 1, further comprising means for judging whether or not the cylinder has been suspended for a long time immediately after a control operation has started, and for causing a braking mechanism to perform an on-off operation several times when it is judged that the cylinder has been suspended for a long time.

3. A cylinder positioning control apparatus according to claim 1, wherein the predicted overrun distance $y_i$ is calculated by use of the following equation with a dead time $t_{lag}$ also inputted:

$$y_i = y_{i-1} + \left\{ \frac{2y_{i-1}}{V_{i-1}} - t_{lag} \right\} (V_i - V_{i-1}) + \frac{(y_{i-1} - V_{i-1}t_{lag})(V_i - V_{i-1})^2}{V_{i-1}^2}$$

and the condition to be satisfied to output a braking signal is calculated by further inputting a displacement $x_t$ of the cylinder being driven, a cylinder displacement $x_{t-1}$ inputted immediately before a present time, and a cylinder stop target displacement $x_r$ and by use of the following equation:

$$(3x_t - x_{t-1})/2 > x_r - y_i$$

and further the predicted overrun distance $y_{i-1}$ in the preceding drive and the cylinder speed $V_{i-1}$ at the time of outputting a braking signal during the preceding drive are calculated by use of the following equation:

$$y_{i-1} = x_{stop} - x_{bp} \text{ and } V_{i-1} = V_{bp}.$$

4. A cylinder positioning control apparatus according to claim 2, wherein the predicted overrun distance $y_i$ is calculated by use of the following equation with a dead time $t_{lag}$ also inputted:

$$y_i = y_{i-1} + \left\{ \frac{2y_{i-1}}{V_{i-1}} - t_{lag} \right\} (V_i - V_{i-1}) + \frac{(y_{i-1} - V_{i-1}t_{lag})(V_i - V_{i-1})^2}{V_{i-1}^2}$$

and the condition to be satisfied to output a braking signal is calculated by further inputting a displacement $x_t$ of the cylinder being driven, a cylinder displacement $x_{t-1}$ inputted immediately before a present time, and a cylinder stop target displacement $x_r$ and by use of the following equation:

$$(3x_t - x_{t-1})/2 > x_r - y_i$$

and further the predicted overrun distance $y_{i-1}$ in the preceding drive and the cylinder speed $V_{i-1}$ at the time of outputting a braking signal during the preceding drive are calculated by use of the following equation:

$$y_{i-1} = x_{stop} - x_{bp} \text{ and } V_{i-1} = V_{bp}.$$

* * * * *